US006220474B1

(12) United States Patent
Bedon

(10) Patent No.: US 6,220,474 B1
(45) Date of Patent: Apr. 24, 2001

(54) CONTAINERS FOR RECEIVING A CERTAIN VOLUME OF LIQUID AND CASE CONSTITUTING SAME

(76) Inventor: Jean-Francois Bedon, Le Village, F-07270 Saint Barthelemy Grozon (FR)

( * ) Notice: Subject to any disclaimer, the term of this patent is extended or adjusted under 35 U.S.C. 154(b) by 0 days.

(21) Appl. No.: 09/319,283

(22) PCT Filed: Dec. 2, 1997

(86) PCT No.: PCT/FR97/02179

§ 371 Date: Jul. 16, 1999

§ 102(e) Date: Jul. 16, 1999

(87) PCT Pub. No.: WO98/24710

PCT Pub. Date: Jun. 11, 1998

(30) Foreign Application Priority Data

Dec. 3, 1996 (FR) ..... 96 14790

(51) Int. Cl.[7] ..... B65D 6/16

(52) U.S. Cl. ..... 220/666; 220/720; 220/705; 215/906

(58) Field of Search ..... 220/666, 563, 220/564, 723, 720, 721, 768, 705; 215/906, 100

(56) References Cited

U.S. PATENT DOCUMENTS

| | | | | |
|---|---|---|---|---|
| 4,032,064 | * | 6/1977 | Giggard | 220/723 |
| 4,256,150 | * | 3/1981 | Mockesch | 220/723 |
| 4,446,991 | * | 5/1984 | Thompson | 220/723 |
| 5,176,178 | * | 1/1993 | Schurter et al. | 220/720 |
| 5,221,021 | * | 6/1993 | Danna | 220/723 |
| 5,524,789 | * | 6/1996 | Jack Man | 220/666 |
| 5,802,940 | * | 1/1999 | Chism et al. | 220/666 |

* cited by examiner

*Primary Examiner*—Joseph M. Moy
(74) *Attorney, Agent, or Firm*—Young & Thompson

(57) ABSTRACT

This container is designed for receiving a liquid through a filler neck (1), then for delivering this liquid under pressure via a nozzle (3), said container being formed by a case (5) with extensible capacity subjected to transforming means which displaces it, in opposition to elastic means, from an inoperative position to a storing position. The invention is characterised in that these means comprise a mechanical member (6) having a structure with linear development comprising a seat (7) and a head (8) and capable of taking up, by control means external to the case, either an expanded position, or a retracted position in which the seat (7) and the head (8) are brought closer and for which the case (5) is urged in its inoperative state by the effect of the elastic means.

20 Claims, 4 Drawing Sheets

CONTAINERS FOR RECEIVING A CERTAIN VOLUME OF LIQUID AND CASE CONSTITUTING SAME

The present invention relates to containers adapted to receive a certain volume of liquid, such as for example a beverage, through a filling neck provided with a plug, and then to deliver the liquid under pressure from an outlet nozzle provided with a valve provided with a control member which can be easily actuated by the user.

The invention relates more particularly to containers formed by envelopes with an expansible capacity subjected to transformation means which causes them to pass, under the influence of resilient means, from a rest condition in which its volume is practically nothing, to a storage condition in which its volume is maximum.

In the use of such containers for the delivery of beverages, there is known for example U.S. Pat. No. 5,062,591, in which the envelope having in situ the resilient means is capable of practically expelling the beverage which has been introduced under pressure by a manual pump.

But this type of container has not only the major drawback of using, as transformation means, an independent pump requiring valves with several passages to withdraw and pressurize the desired beverage, but also a large size due to the round shape of the balloon obtained and a difficulty particularly during transfer from the source of liquid to the container, and even an impossibility to refill from a faucet. Moreover, as will be understood, the expansion of the envelope by the resilient means is a function directly of the liquid introduced under pressure, and hence of the power of the pump.

Thus, if it is desired that the beverage be delivered under pressure for as long as possible, it is necessary to have a high power pump, which is incompatible with the size and independence of use and hence of the provision of a self-contained container.

In the use of containers as described above, with aerosol sprays, the expansible envelope is generally returned to its rest condition by a propulsive gas which is difficult to replace by simple means or which is accessible to the public.

The present invention thus has for its object to provide a container for liquid which does not have the drawbacks described above and which permits its use in the most convenient manner for various applications.

According to the invention, the transformation means comprises a mechanical member, having a structure of linear development, which comprises a base and a head which come respectively into engagement with two opposite regions of the envelope and which are adapted to occupy, by control means external to the envelope, either an expanded position in which the base and the head maintain at a distance the two opposite regions of the envelope thanks to the resilient means and in which the envelope occupies its storage condition, or a retracted position in which the base and the head are brought toward each other and in which the envelope tends to come to its rest position under the influence of the resilient means.

Thus, thanks to this mechanical member which acts on two opposite regions of the envelope, there is obtained an easy expansion which is controlled with complete safety, always equal to that specified by the manufacturer and corresponding to the maximum storage condition.

On the other hand, when the mechanical member is returned to its retracted position, the envelope subjected to the resilient means immediately places the liquid under pressure, which can then be withdrawn as desired until it occupies its rest position. It is also of interest to note that the retracted position reached by the mechanical member permits guaranteeing minimum size when the container is brought to its rest condition.

According to one preferred characteristic of the invention, the external control means comprises a blocking device adapted to retain the mechanical member in its expanded and retracted positions.

Thus, when the envelope is maintained in its storage condition thanks to the resilient means, it will be understood that it is easy for the user to fill it through its neck with any liquid at all, from all sorts of spigot, bottle, etc. sources.

Moreover, in this storage condition, it will be understood that it is easy to wash, rinse, then to dry completely the interior of the envelope so as to avoid any microbial proliferation.

According to another interesting characteristic of the invention, the mechanical member being arranged within the envelope, and the base being secured to the filling neck, the external control means of the mechanical member is constituted by the plug which can take, for this purpose, an open position in which the mechanical member occupies its expanded position and in which the filling of the container is permitted, and a closed position in which the mechanical member occupies its retracted position and in which the envelope is returned toward its rest position by the resilient means, thereby placing the liquid under pressure.

This arrangement results particularly in great convenience for the user and simplification of production by grouping the various mechanical members in a single position in the envelope, whilst satisfying the need for a good appearance of the container.

So as to make the invention particularly inexpensive and compact, and according to another particularly preferred characteristic, the envelope and resilient means are constituted by at least one piece made of a resilient material and preferably the envelope is formed in two flat pieces from a resilient material which are practically joined and fixed solely by their peripheral edge, thereby constituting in its rest condition a flat pocket, the filling neck being mounted on one of said pieces.

The flat and flexible pocket thus constituted is quite interesting not only for storage after production, but also particularly when the container is used as a container for beverage and carried empty by the user at the end of its use. Thus, the envelope which is placed under pressure having no round and cumbersome shape like a balloon, the container has a volume of bulbous shape and nevertheless flattened, which is very handy for its use and its storage in a bag or pocket of clothing.

Moreover, as the sealed envelope in its rest condition has the smallest possible internal volume, which volume is connected to the proximity of the two flat pieces, the practically complete expulsion of the liquid content is practically guaranteed, except at the end film of liquid stored protected from the air and which thus prevents the entry of air between the pieces as well as the introduction of foreign materials into the envelope and as a result prevents the formation and/or the proliferation of mold.

The characteristics and advantages of the invention will become further apparent from the description which follows, given by way of non-limiting example, with reference to the accompanying drawings, in which.

Figure 1:
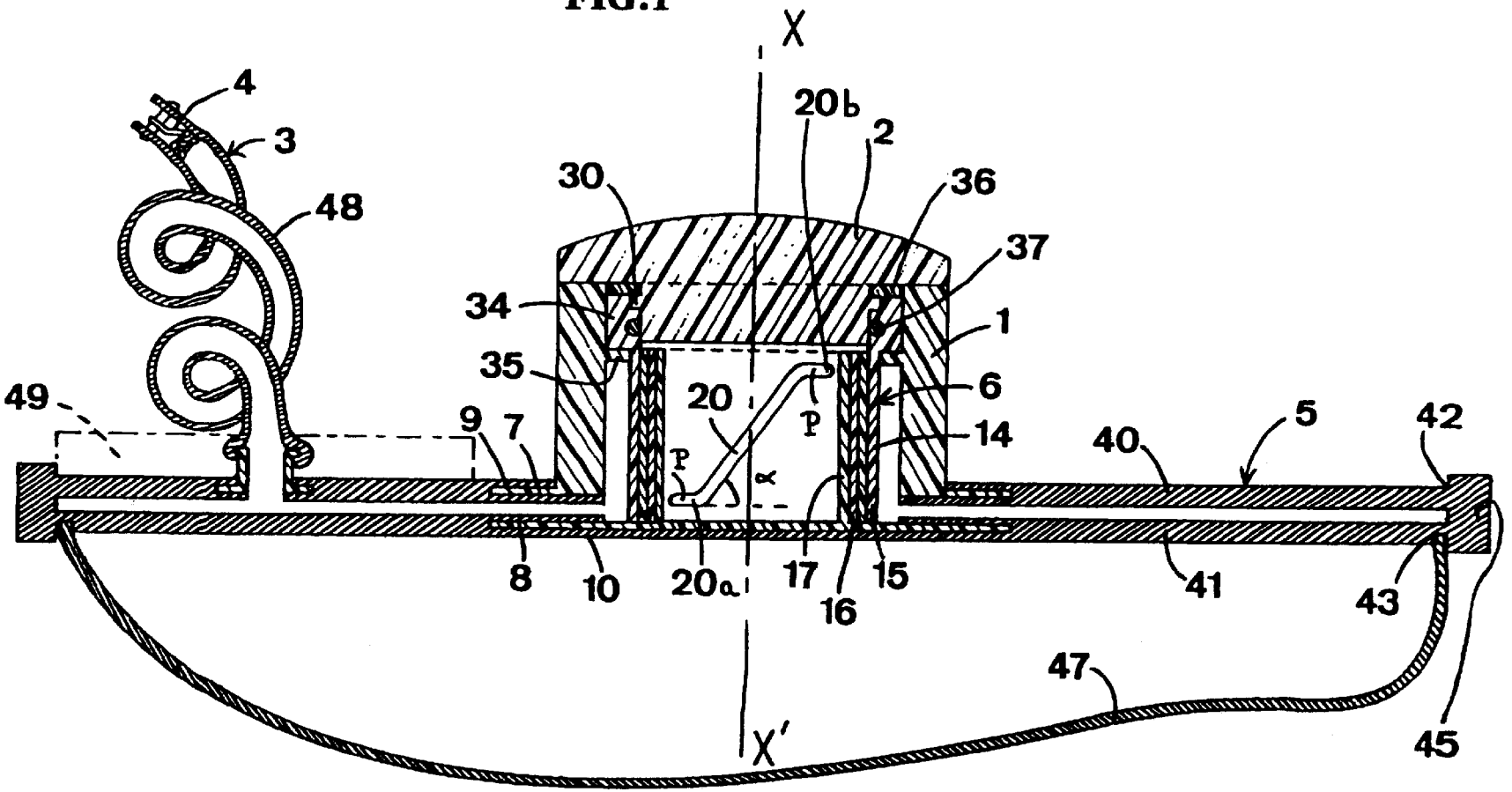
FIG. 1 is a vertical cross-sectional view of a container according to the invention and shown with its envelope in the rest position.

The container shown in FIG. 1 is adapted to receive a certain volume of liquid through the filling neck 1 provided with a plug 2 and then to deliver the liquid under is pressure from an outlet nozzle 3 provided with a valve 4 provided with a control member. The word "liquid" used in the present application relates preferably to a beverage but could also define any fluid, for example gasoline, oil, blood . . . that it is desired to deliver in small volumes.

The container is comprised by an envelope 5 with an expansible capacity subjected to transformation means which causes it to pass, under the influence of resilient means, from a rest position (FIG. 1) in which its internal volume is practically zero, toward a storage position (FIGS. 2 and 4) in which its volume is maximum.

According to the invention, the transformation means comprise a mechanical member 6, having a structure of linear development, which comprises a base 7 and a head 8 coming into engagement with two opposite regions 9–10 of the envelope 5 and which is adapted to occupy, by control means external to the envelope, either an expanded position in which the base 7 and the head 8 maintain at a distance the two opposite regions 9–10 of the envelope 5 due to the resilient means and in which the envelope occupies its storage position, or a retracted position in which the base 7 and the head 8 are brought toward each other and in which the envelope 5 tends to come into its rest position under the influence of the resilient means.

In the embodiment shown in the figures, envelope 5 and the resilient means are constituted by at least one piece of an elastic material. Preferably, the elastic material, having given satisfaction during multiple tests, is an elastomer having characteristics of resilient deformation, elongation and remanenc of the rest condition suitable for filling and the pressurization of a beverage. Such an elastomer is for example a thermoplastic elastomer of the KRATON SBS type of food grade. This elastomer also has the advantage of being moldable and weldable in a sealed manner on rigid elements forming the base 7 and the head 8.

Of course, without departing from the scope of the invention, the envelope 5 could be made of a non-elastic deformable material, and the resilient means thus would be formed from a separate piece in engagement with a structure adapted to expand and return thanks to the resilient means, into a rest position in which it also brings the envelope into its rest position. Such a structure could for example be of the pantograph type with spring extension.

In a practical embodiment of the invention, the mechanical member 6 being arranged within the envelope 9, the base 7 and the head 8 are fixed respectively on the two opposite regions 9–10 of the inner wall of the envelope. This securement can be carried out for example by gluing, welding or overmolding of the base 7 and the head 8 on the envelope.

Figure 4:
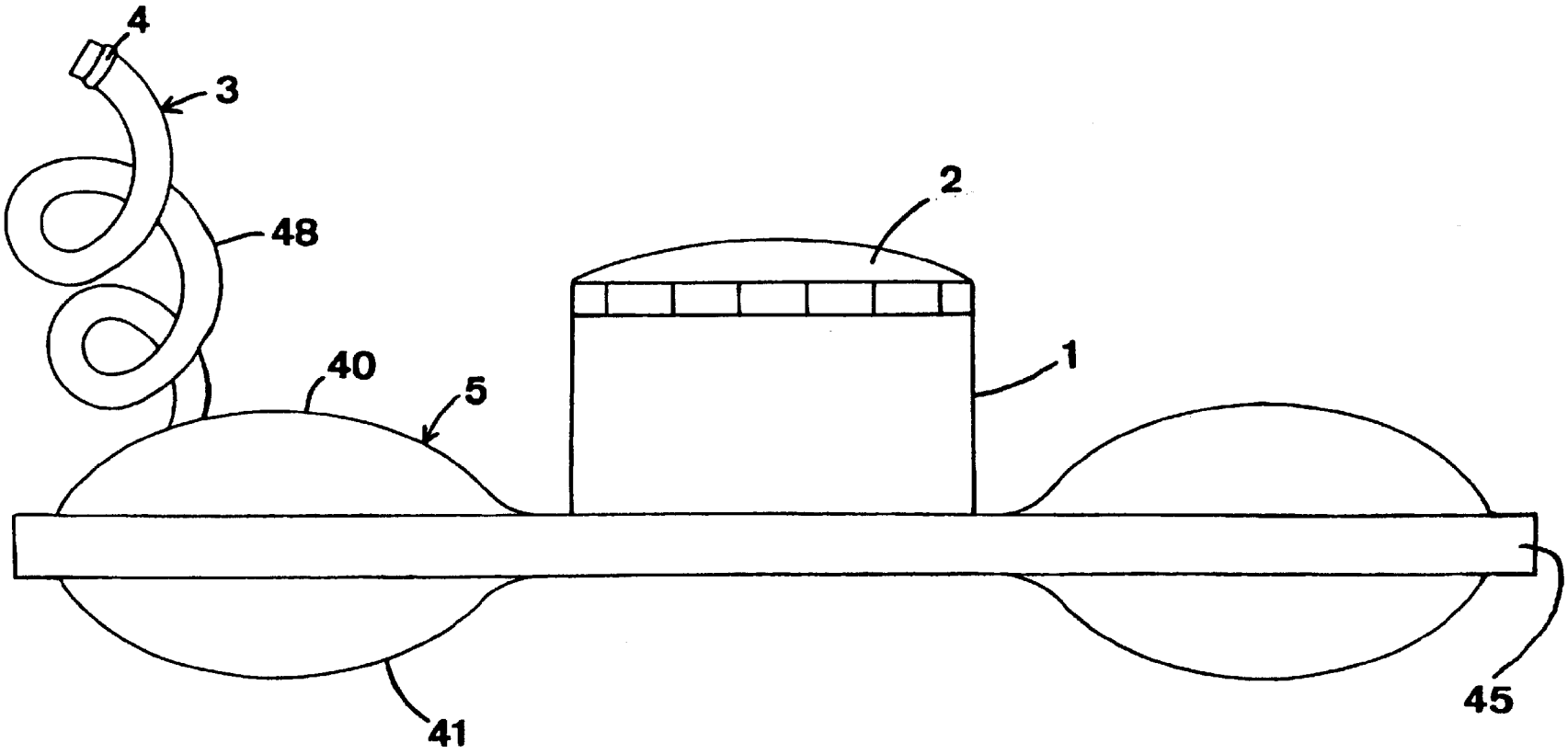
FIG. 4 is an elevational view showing an example of the envelope when the linear structure is in retracted position.

Thus, when the container is full of liquid and thanks to the securement of the head 8 to the region 10 of the envelope, the two opposite regions 9 or 10 are brought together by the control means, thereby increasing the pressure in the envelope by compression of its volume due to the resilience of the elastomeric envelope (see FIG. 4).

According to another embodiment (not shown), the mechanical member 6 being also arranged within the envelope 9, the base 7 is fixed in a region of the internal wall of the envelope, whilst the head 8 is freely mounted in said envelope As a result, when the container is full of liquid, the mechanical member 6 is returned to its retracted position without any force at the level of the external control means but induces no supplemental pressure in the envelope.

So as to increase to the maximum the capacity of the container, the base 7 of the mechanical member 6 is secured to the filling neck 1. Thus, the structure of linear development develops along a common longitudinal axis X—X' of the filling neck.

Thanks to this arrangement and according to another important characteristic of the invention, the external control means of the mechanical member 6 is constituted by the plug 2 which can have for this purpose an open position in which the mechanical member occupies its expanded position (FIG. 2) and in which the filling of the container is permitted after removal of the plug 2 from the filling spout 1, and a closed position in which the mechanical member is returned to its retracted position (FIG. 4) and in which the envelope is returned to its rest condition by the resilient means, thereby placing the liquid under pressure.

Figure 3:
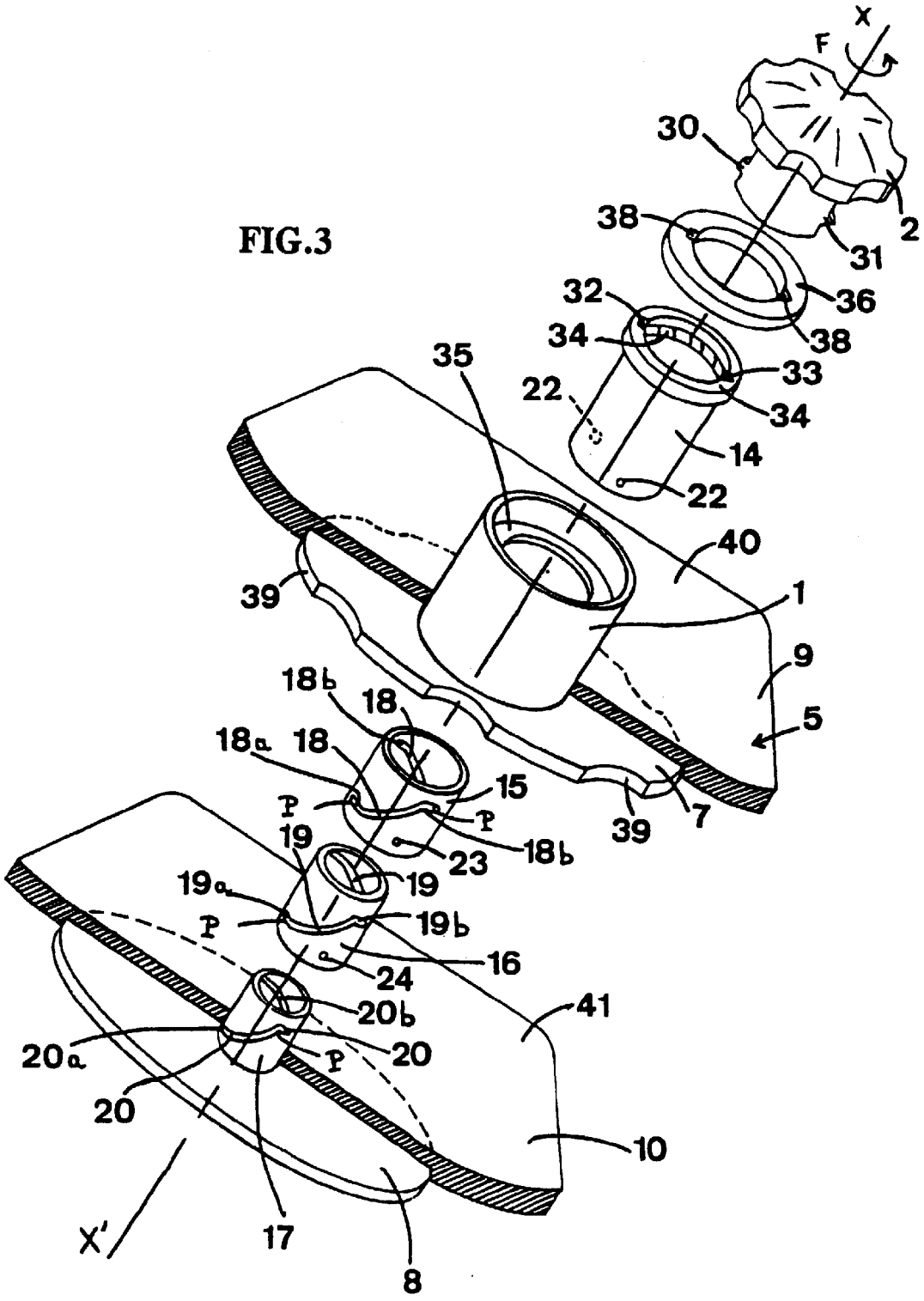
FIG. 3 is an exploded view on a smaller scale, of a detail and embodiment of a transformation means for the conditions of the envelope according to the invention and shown in fragmentary cross-section in a transverse plane in FIG. 2.

As is better seen in FIG. 3, the mechanical member comprises a linear telescopic structure constituted by several tubular elements, namely in the illustrated example, but without limitation, four elements respectively indicated by 14, 15, 16 and 17, contained in each other along a common axis XX' and of which the first, 14, so-called pilot element, is mounted rotatably in the filling neck 1 secured to the base 7, is manipulated by the plug 2 mounted for this purpose also rotatably in the neck and causes the linear development of said structure whilst the last element 17 carries at its end the head 8 fixed to the wall of the envelope.

Each tubular envelope comprises, on the one hand, except the lead element 14, a series of helicoidal grooves, in the present case a pair of grooves indicating respectively by 18, 19 and 20 having lower ends 18*a*, 19*a*, 20*a* and upper ends 18*b*, 19*b*, 20*b*, as well as on the other hand, except for the last element 17, a series of drive lugs, in the present case a pair indicated respectively at 22, 23 and 24, adapted to come into contact respectively in the grooves. So as to ensure the most economical production, and to optimize functionality, said grooves are formed by windows which thus constitute passages for flow of the liquid into the envelope during filling and rinsing.

The helical angle $\alpha$ (FIG. 1) of each helicoidal groove 18, 19, 20 is selected within the range of 35° to 50° and preferably equal to 45°, so as to promote the extension of the telescopic structure with a rotative couple suitable for the hand of the user. The arrangement of the grooves on the three tubular elements permits obtaining complete development of the structure with only three-quarters of a turn of the lead element 14.

So as to drive in rotation the lead element 14, there is provided on the plug 2 two diametrically opposed lugs 30, 31 adapted to come into engagement with two diametrically opposed recesses 32, 33 provided in a collar 34 located in the upper portion of the lead element 14.

With reference particularly to FIG. 3, the lead element comes to rest with its collar 34 on an annular internal bearing 35 of the neck 1 and is maintained axially in said neck by means of an annular key 36 which bears on the upper surface of the collar 34, the collar 34 being of course freely mounted in rotation between the bearing 35 and the key 36. In the example of embodiment, the key 36 is welded to the internal wall of the neck 1, but any other means of securement could be envisaged. Moreover, this key has two diametrically opposed recesses 38 which are adapted to let pass the pins 30 and 31 of the plug 2.

As will be understood, to ensure the sealing between the pilot tubular element 14 and the internal wall of the filling neck 1, the two pieces are clamped with an outlet spout. Also, sealing between the lead tubular element 14 and the rotatable plug 2 is provided by an annular joint 37 disposed in the internal wall of the collar 34 and adapted to come into contact with the lateral wall of the plug 2. Thus, the nipping couple is reduced during opening and closing of the container and the sealing and locking of the tenons 30 and 31 below the key are simultaneously ensured.

According to still another important characteristic of the invention, and as shown in FIG. 1, the envelope 5 is formed by two flat pieces 40 and 41 made of a resilient material which are practically glued and secured solely by their peripheral edge 42 and 43, thereby constituting in its rest condition a flat pocket, the filling neck secured to the base 7 being therefore mounted on 1, 40 of said pieces, whilst the head 8 is fixed to the other piece 41. By way of example, the base 7 and the head 8 are overmolded throughout the thickness of said pieces. As is better seen in FIG. 3, and according to a more preferred and ergonomic embodiment, the base 7 and the head 8 each have an elliptical shape, the base 7 having a surface equal to that of the head 8. So as to improve the gripping of the container particularly during handling of the plug, the base 7 has several handholds 39 serving as holds for the fingers of the user through the envelope 5.

This preferred elliptical shape of the-base, of the head and of the envelope is the fruit of several trials and permits obtaining a good and equal distribution of the forces exerted on the envelope 5 during passages from the rest condition to the storage condition and vice versa. This redistribution of the constraints is very interesting in the presence of an envelope with a thin wall so as to avoid tearing at the peripheral junction of the head and of the base on the envelope. On the other hand, the elliptical shape given to the head permits contributing to maintaining a volume which is more ogival and spherical in the storage condition.

In the example shown in FIG. 1 and so as to guarantee a flattened end bombous shape of the container under pressure, the envelope 5 comprises a rigidifying frame formed by a peripheral flange 45 whose thickness is greater than that of the assembly of the two flat pieces 40 and 41 secured together in the rest position.

In a preferred embodiment, the flange 45 is formed by an elastomer of the same type as that of the flat pieces and because of its configuration acquires a hardness greater than that of the flat pieces 40, 41. As will be understood, this peripheral flange ensures the resilient balancing between the two pieces 40 and 41 during their deformation toward the storage condition so as to contribute to obtaining a volume which is at little encumbering as possible. This flange serves as a dimensional reference frame for the return of the resilient flat pieces 40 and 41.

There will now be described the operation and use of the container by a hiker in the framework particularly of the storage of a liquid such as a beverage. For greater convenience, the container is inserted in a suitable cloth pocket, leaving the filling neck 1 protruding, and adapted to be attached to a belt of the user. In another embodiment, the container is provided directly with a carrying device 47 such as a bandolier.

Figure 2:
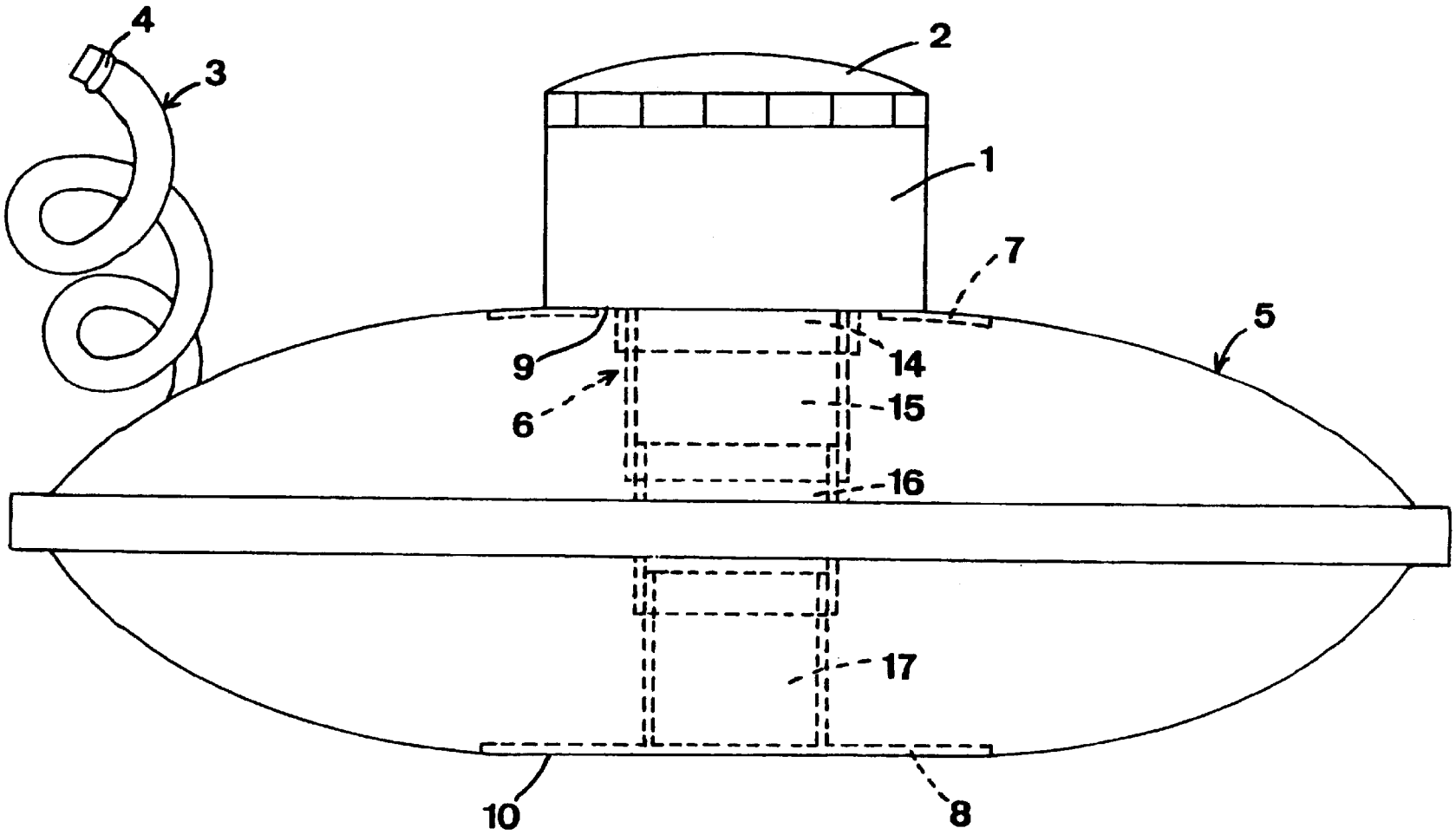
FIG. 2 is an elevational view of the container of FIG. 1 showing the envelope in its storage condition and a structure with linear development in the expanded position.

Referring to FIGS. 1 and 2, it will be noted that the outlet nozzle 3 comprises a flexible tube 48 whose free end carries the valve 4 provided with its control member. This valve 4 is of a well-known type not shown in detail and comprising a flexible tube and a valve with a movable ball whose position relative to a fixed seat is modified by partial crushing of the tube under the influence of pinching exerted by the mouth of the user. The tube 48 can be a spiral tube of the extensible type and the container comprises a recess 49 (shown in broken lines) for receiving the flexible tube in its stored position. The spiral tube 48 reduces the size but must satisfy both conditions of flexibility and rigidity to withstand the pressure of the liquid without undergoing untimely extension.

Beginning with the rest condition of the envelope, and hence the telescoped condition of the various elements 14 to 17, there is given to the plug 2 a rotation in the direction of the arrow F in FIG. 3 (counterclockwise direction). The two lugs 30, 31 in engagement with the recesses 32, 33 thus drive in rotation the lead element 14.

As all the lugs 22, 23 and 24 are located in the lower ends 18*a*, 19*a* and 20*a* of the grooves, the lugs 22 first leave the lower ends 18*a* and slide in the grooves 18 causing conjoint rotation and translation of the element 15 along the common axis XX' until the lugs 22 come into abutment on the upper ends 18*b* thereby rendering the element 15 secure in rotation with the lead element 14, it follows that the pins 23 of this lead element in their turn leave the lower ends 19*a* and slide along the grooves 19 causing conjointly rotation and translation of the element 16 until the pins 23 come into abutment against the ends 19*b*, thereby giving the linear structure a first substantial extension. As to the second element 17 secured to the head 8 immobilized in the cloth pocket, it will be understood that the lugs 24 of the element 16 cause only a translation of the element 17 to bring the linear structure into its expanded position and hence the envelope 5 into its storage condition.

As is seen in FIG. 3, each groove has respectively, at its end portions adjacent the ends 18*a*–20*a*; 18*b*–20*b*, a transverse region p transverse to the helicoidal pitch so as to ensure the holding of the structure in its expanded position without risk of abrupt collapse and in the retracted position to maintain it under pressure by the elasticity of the envelope.

In this expanded position, the user removes the plug 2 from the filling neck 1 and pours the beverage through grooves in the envelope 5. Once the container is filled, the user replaces the plug 2, locks it beneath the key 36 by means of two lugs 30 and 31 which come into engagement with the recesses 32, 33 and gives to it a rotation reverse to that of the arrow F, giving rise to a specified sequence of disengagement of the lugs 22, 23, 24 respectively from the upper ends 18*b*, 19*b*, 20*b* toward the lower ends 18*a*, 19*a*, 20*a* giving rise successively by rotation and translation to movements of the elements 15, 16 and 17 in an opposite direction relative to the movements described above during expansion.

As the head 8 is secured to the envelope 5, the passage of the structure from its expanded position to its retracted position consecutive to the securement of the head 8 to the base 7, brings said envelope (see FIG. 4) to have a volume of a generally toric shape, thereby contributing with the intrinsic elasticity of the envelope 5 to increase the pressure on the beverage. Said envelope therefore passes from its storage condition of the balloon type (FIG. 2) to another storage condition (FIG. 4) differing by its final toric shape.

The beverage container being thus under pressure, the user desiring to drink brings by deployment of the tube 48 the nozzle 3 to his mouth, and acts on the control member of the valve 4 thereby freeing the beverage under pressure. The envelope 5 stretched to the center of the elliptical peripheral flange propels by its elasticity in a regular manner the beverage from the envelope until the final approach of the two flat pieces 40 and 41 corresponding to the minimum internal volume.

The invention provides among other things the provision of the container with a second valve which permits the escape of air at the end of filling so as to obtain in the envelope only the storage of the liquid, thereby guaranteeing delivery of this liquid without a gas dome and no matter what the external atmospheric pressure. Of course, for the sake of economy this function of communication with the ambient air could be performed by the valve 4.

What is claimed is:

1. Container adapted to receive a certain volume of liquid through a filling neck (1) provided with a plug (2) and thereafter to deliver the liquid under pressure from an outlet nozzle (3) provided with a valve (4) provided with a control member, said container being comprised for this purpose by an envelope (5) of expansible capacity subject to a transformation means which makes it change, under the influence of resilient means, from a rest condition in which its volume is practically nothing toward a storage condition in which its volume is maximum, characterized in that the transformation means comprise a mechanical member (6), having a structure of linear development, which comprises a base (7) and a head (8) coming respectively into engagement with two opposite regions (9–10) of the envelope and which is adapted to occupy, by control means external to the envelope, either an expanded position in which the base (7) and the head (8) maintain spaced the two opposite regions (9–10) of the envelope (5) via the elastic means and in which the envelope occupies its storage condition, or a retracted position in which the base (7) and the head (8) are brought toward each other and in which the envelope (5) tends to come to its rest position under the influence of the elastic means.

2. Container according to claim 1, characterized in that the mechanical member (6) being arranged within the envelope (5), the base (7) and the head (8) are fixed respectively to the two opposite regions (9–10) of the internal wall of the envelope.

3. Container according to claim 1, characterized in that the mechanical member (6) being arranged within the envelope (5), the base (7) is fixed to a region of the internal wall of the envelope, whilst the head (8) is freely mounted in said envelope (5).

4. Container according to claim 2, characterized in that the base (7) is secured to the filling neck (1).

5. Container according to claim 1, characterized in that the external control means of the mechanical member is constituted by the plug (2) which can have, for this purpose, an open position in which the mechanical member occupies its expanded position and in which the filling of the container is permitted, and a closed position in which the mechanical member is returned to its retracted position and in which the envelope is returned toward its rest position by the resilient means, thereby placing the liquid under pressure.

6. Container according to claim 5, characterized in that the mechanical member (6) comprises a telescopic structure constituted by several tubular elements (14, 15, 16, 17) telescoping within each other and of which the first (14), called the lead element, is mounted in rotation on the base, is manipulated by the plug (2) mounted for this purpose also in rotation and gives rise to the linear development of the structure, whilst the last (17) carries the head (8).

7. Container according to claim 6, characterized in that each tubular element, except the lead element 14, comprises, on the one hand, a series of helicoidal grooves (18 to 21), having respectively lower ends (18*a* to 20*a*) and upper ends (18*b* to 20*b*), as well as, on the other hand, except the last element (17), a series of drive lugs (22 to 24) adapted to come into engagement respectively in the grooves, said grooves being formed by openings also constituting the flow passages for the liquid in the envelope upon filling and rinsing.

8. Container according to claim 7, characterized in that each groove (18 to 21) has respectively in its end portions adjacent the lower ends (18*a* to 20*a*) and upper ends (18*b* to 20*b*) a region P transverse to the helicoidal pitch so as to ensure holding the telescopic structure in expanded and retracted positions.

9. Container according to claim 7, characterized in that the helix angle ($\alpha$) of each groove is selected within the range 35° to 50° and preferably equal to 45°, so as to promote the extension of the telescopic structure upon imposition of a suitable rotative couple.

10. Container according to claim 6, characterized in that the plug (2) comprises two diametrically opposed lugs (30, 31) adapted to come into engagement with two diametrically opposed recesses (32, 33) and provided in a collar (34) of the lead element.

11. Container according to claim 10, characterized in that between the tubular element (14) and the plug (2) is disposed in the internal wall of the collar (34) an annular sealing joint (37).

12. Container according to claim 1, characterized in that it is adapted to contain a beverage liquid, and the outlet nozzle (3) comprises a flexible tube (48) whose free end carries the valve (4) provided with its control member.

13. Container according to claim 12, characterized in that it comprises a recess (49) for receiving the flexible tube (48), said tube being a spiral tube of the extensible type.

14. Container according to claim 12, characterized in that it is provided with a carrying device (47).

15. Container according to claim 1, characterized in that the envelope (5) and the resilient means are constituted by at least one piece of a resilient material having the characteristics of deformation, elongation and remanenc in the rest condition.

16. Container according to claim 15, characterized in that the envelope (5) is formed of two flat pieces (40, 41) of a resilient material which are practically secured and fixed only by their peripheral edges (42, 43), thereby constituting in its rest condition a flat pocket, the filling neck being mounted on one of said pieces.

17. Envelope adapted to constitute a container and comprising two flat pieces produced according to claim 16, characterized in that the resilient material is an elastomer having elastic characteristics of deformation, elongation and remanenc in the rest condition, suitable for filling and for placing the liquid under pressure.

18. Envelope according to claim 17, characterized in that the envelope (5) comprises a rigidification frame.

19. Envelope according to claim 18, characterized in that the frame is formed by a peripheral flange (45) whose thickness is greater than that of the assembly of the two flat secured together pieces (40, 41).

20. Envelope according to claim 19, characterized in that the flange (45) is formed by an elastomer of the same type as that of the elastomer constituting the flat pieces.

* * * * *